US006278974B1

(12) United States Patent
Lin

(10) Patent No.: US 6,278,974 B1
(45) **Date of Patent: *Aug. 21, 2001**

(54) HIGH RESOLUTION SPEECH SYNTHESIZER WITHOUT INTERPOLATION CIRCUIT

(75) Inventor: James J. Y. Lin, Hsin-Chu (TW)

(73) Assignee: Winbond Electronics Corporation, Hsin-Chu (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/976,155

(22) Filed: Nov. 21, 1997

Related U.S. Application Data

(63) Continuation-in-part of application No. 08/436,802, filed on May 5, 1995, now abandoned.

(51) Int. Cl.[7] ..... G10L 13/02
(52) U.S. Cl. ..... 704/267; 704/268
(58) Field of Search ..... 704/212, 211, 704/230, 258, 265, 267; 341/51, 76

(56) References Cited

U.S. PATENT DOCUMENTS

| | | | |
|---|---|---|---|
| 4,435,832 | 3/1984 | Asada et al. | 704/265 |
| 4,885,790 | * 12/1989 | McAuley et al. | 704/265 |
| 5,111,505 | 5/1992 | Kitoh et al. | 704/265 |
| 5,694,518 | * 12/1997 | Takahashi et al. | 704/212 |

OTHER PUBLICATIONS

L.R. Rabiner, et al., "Digital Processing of Speech Signals," 1978, pp. 28–30, 225–232.

J.R. Deller, et al., "Discrete–Time Processing of Speech Signals," 1987, pp. 434–444.

S. Furui, "Digital Speech Processing, Synthesis, and Recognition," 1989, pp. 143–149.

* cited by examiner

*Primary Examiner*—William Korzuch
*Assistant Examiner*—Martin Lerner
(74) *Attorney, Agent, or Firm*—Knobbe, Martens, Olson & Bear, LLP

(57) ABSTRACT

The present invention is related to a speech synthesizer which includes a sampled signal storing device storing therein a sampled signal and outputting the sampled signal in response to an input signal, and a speech signal synthesizing circuit electrically connected to the sampled signal storing device, receiving an operation signal, having the sampled signal outputted by the sampled signal storing device be repeatedly operated in response to the operation signal, and then outputting a speech synthesized signal, wherein a frequency of the operation signal is higher than that of the input signal to allow the sampled signal to be repeatedly operated during a single cycle of the input signal. The present invention proceeds a plurality of times of operation for each entry of data in the storing device so that the synthesizing performance of the present synthesizer can be improved without increasing the storage amount of the sampled signals.

9 Claims, 10 Drawing Sheets

HIGH RESOLUTION SPEECH SYNTHESIZER WITHOUT INTERPOLATION CIRCUIT

This is a continuation-in-part application of U.S. patent application Ser. No. 08/436,802, filed on May 5, 1995, now abandoned.

FIELD OF THE INVENTION

The present invention is related to a signal synthesizer, and particularly to a speech synthesizer.

BACKGROUND OF THE INVENTION

Generally speaking, some problems are encountered in the field of speech synthesis. For example, it is difficult to spend lower signal storage cost to obtain higher speech synthesizing performance. The current measure for achieving a proper compromise between the signal storage cost and the speech synthesizing performance generally decreases the sampling frequency to reduce the storage amount of sampled signals for economizing the signal storage cost, and utilizes an interpolation or a compensation method to increase the smoothness of the outputted signals for obtaining a satisfactory speech quality.

Please refer to FIG. 1 which is a block diagram showing a conventional speech synthesizer. The speech synthesizer 1 shown in FIG. 1 includes a speech ROM 11, a speech signal synthesizing circuit 12, an oscillation circuit 13, a control circuit 14 and a D/A converting circuit 15. The oscillation circuit 13 is used for generating a clock necessary for the speech synthesizer 1. The control circuit 14 is used for serving as an input/output processing interface. The speech signal synthesizing circuit 12 and the speech ROM 11 are electrically connected at point F so as to obtain the same frequency. When the speech signal synthesizing circuit 12 reads a speech signal from the speech ROM 11, a speech synthesized signal is outputted through point T. The working principles of the speech ROM 11 and the D/A converting circuit 15 are known to those skilled in the art so that they are not to be redundantly described here.

The interpolation method used for improving the speech synthesizing performance of the conventional speech synthesizer is illustrated with reference to FIGS. 2A and 2B. FIG. 2A shows that an additional block representing an interpolation circuit 2 is electrically connected between the speech signal synthesizing circuit 12 and the D/A converting circuit 15 of the speech synthesizer shown in FIG. 1. The interpolation circuit 2 includes a delay circuit 21, a D/A converting circuit 22 and a summation circuit 23. FIG. 2B schematically shows the waveform of the speech synthesized signals generated by the speech synthesizer shown in FIG. 2A. The solid line portions R and dash line portions E in FIG. 2B respectively represent the signals respectively outputted through lines DA1 and DA2 in FIG. 2A. The speech synthesized signal outputted through point T has first been processed by the summation circuit 23.

Because the interpolation circuit 2 is a circuit externally applied to the conventional speech synthesizer 1, the circuitry of the entire synthesizer will become more complicated when the interpolation circuit 2 is applied, and thus the cost will be increased.

Of course, another circuit can be used for improving the speech synthesizing performance. Please refer to FIG. 3, in which the block representing the interpolation circuit 2 in FIG. 2A changes into a block representing a compensation circuit 3. The compensation circuit 3 includes an up/down counter 31, a D/A converting circuit 32 the same as the D/A converting circuit 22 of FIG. 2A and a summation circuit 33 simpler than the summation circuit 23 of FIG. 2A.

The working principle of the speech synthesizer shown in FIG. 3 is illustrated by an example hereinafter. Assuming that the output of the speech signal synthesizing circuit 12 is a set of most signed bit (MSB) data from Bit 12 to Bit 4, the MSB data initiate the compensation circuit 3 and are also inputted into the D/A converting circuit 15, and then a signal is outputted via the line DA3 after the MSB data have been completely transmitted through the D/A converting circuit 15. On the other hand, after the converting circuit 3 is initiated, a set of least signed bit (LSB) data from Bit 3 to Bit 0 are outputted by the up/down counter 31 and manipulated through the D/A converting circuit 32 to have another signal outputted via the line DA4. The signal outputted via line DA4 is inputted into the summation circuit 33 together with the signal outputted via line DA3 to be processed, and then a Bit 12~Bit 0 speech synthesized signal with better speech quality is outputted via point T. The summation circuit 33 in this case is much simpler than that in the case shown in FIG. 2B because the MSB data generated by the speech signal synthesizing circuit 12 and the LSB data generated by the compensation circuit 3 are separately processed. However, the compensation circuit 3 is still an external circuit as the interpolation circuit 2 is, so the total cost is still high.

In general, if a speech synthesizer having a satisfactory performance is designed primarily based on the basic structure of the synthesizer shown in FIG. 1, the cost will be economized to a great extent since in such a speech synthesizer, the interpolation circuit 2 and the compensation circuit 3 are not required, and the design cost and the material cost are accordingly reduced.

Asada et al. (U.S. Pat. No. 4,435,832) discloses a speech synthesizer having a speech parameter memory, a register and an interpolator for a synthesizing operation. The speech parameter memory stores data such as for PARCOR coefficients obtained by analyzing the speech wave, amplitudes, pitches, voice/un-voice switching and the like. The register temporarily stores therein the parameters delivered from the speech parameter memory, and the interpolator interpolating these parameters before the synthesizing operation. Since the external interpolating circuit is needed for Asada et al.'s device, it is accordingly bearing on the problems described above.

SUMMARY OF THE INVENTION

An object of the present invention is to provide a speech synthesizer which can display a satisfactory performance without raising the cost under a condition of reducing the storage amount of speech signals.

In accordance with the present invention, a speech synthesizer includes a sampled signal storing device storing therein a sampled signal and outputting the sampled signal in response to an input signal, and a speech signal synthesizing circuit electrically connected to the sampled signal storing device, receiving an operation signal, having the sampled signal outputted by the sampled signal storing device be repeatedly operated in response to the operation signal, and then outputting a speech synthesized signal, wherein a frequency of the operation signal is higher than that of the input signal to allow the sampled signal to be repeatedly operated during a single cycle of the input signal. The input signal is generally a reading signal.

In accordance with another aspect of the present invention, the sampled signal is repeatedly operated by the speech synthesizing circuit in a manner that an operation result of the sampled signal is operated again to obtain another operation result. The operation signal and the input signal are respectively inputted into the sampled signal storing device and the speech signal synthesizing circuit. The sampled signal storing device can be a speech ROM.

In accordance with another aspect of the present invention, the sampled signal is generated by having an amplitude of the sampled result divided by a converting parameter in a differential pulse code modulation (DPCM) speech synthesizing system. The sampled signal is operated according to an operation equation (a) listed below:

$$A(t+1/M)=A(t)+D_i \qquad (a),$$

wherein

A(t) is an amplitude of the sampled signal at a variable time t; A(t+1/M) is an amplitude of the sampled signal at a variable time (t+1/M); M is the converting parameter; and $D_i$ is an amplitude of the ith sampled signal stored in the sampled signal storing device. The equation (a) has a boundary condition of A(O)=0 and a known condition of $D_i=A_i/M$ wherein $A_i$ is the amplitude of the ith sampled result, and the sampled signal is sequentially operated M times. The amplitude $D_i$ remains unchanged during a time interval between t and (t+1).

In accordance with another aspect of the invention, the sampled signal is generated by having the sampling result processed by an amplitude magnitude function and a quantization-step differential function in an adaptive differential pulse code modulation (ADPCM) speech synthesizing system. The sampled signal is operated according to operation equations (b) and (c) listed below:

$$A(t+1/\mathrm{M})=A(t)+f_1(Q(t))*D_i=A(t)+A_i^j \qquad (b),$$

and $$Q(t+1/\mathrm{M})=Q(t)+f_2(Q(t),\mathrm{D}_i) \qquad (c),$$

wherein A(t) is an amplitude of the sampled signal at a variable time t;

A(t+1/M) is an amplitude of the sampled signal at a variable time (t+1/M);

Q(t) is a quantization step of the sampled signal at the variable time t;

Q(t+1/M) is a quantization step of the sampled signal at the variable time (t+1/M); M is the converting parameter; $f_1(Q(t))$ is an amplitude magnitude function of Q(t); $f_2(Q(t),D_i)$ is a quantization-step differential function of Q(t) and Di; $D_i$ is an amplitude of the ith sampled signal stored in the sampled signal storing device; and $A_i^j$ is an amplitude magnitude of said ith sampled signal after said sampled signal is processed; times wherein $1 \leqq j \leqq M$.

The equation (b) includes a boundary condition of A(0)=0 and a known condition of $$A_i = \sum_{j=1}^{M} A_i^j$$

wherein $A_i$ is the amplitude of the ith sampled signal, and the sampled signal is sequentially operated M times. The amplitude $D_i$ remains unchanged during a time interval between t and (t+1).

The present speech synthesizer preferably further includes a clock signal generator electrically connected to the sampled signal storing device and the speech signal synthesizing circuit for outputting the input signal to the sampled signal storing device and outputting the operation signal to the speech signal synthesizing circuit. The clock signal generator can be an oscillation circuit capable of generating and outputting signals having different kinds of frequencies.

Moreover, the present speech synthesizer preferably includes a control circuit electrically connected to the signal generator and the speech signal synthesizing circuit for serving as an input/output processing interface, and a digital/analog converting circuit electrically connected to the speech signal synthesizing circuit for transforming the speech synthesizing signal from a digital signal into an analog signal to be outputted.

The present invention may best be understood through the following description with reference to the accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
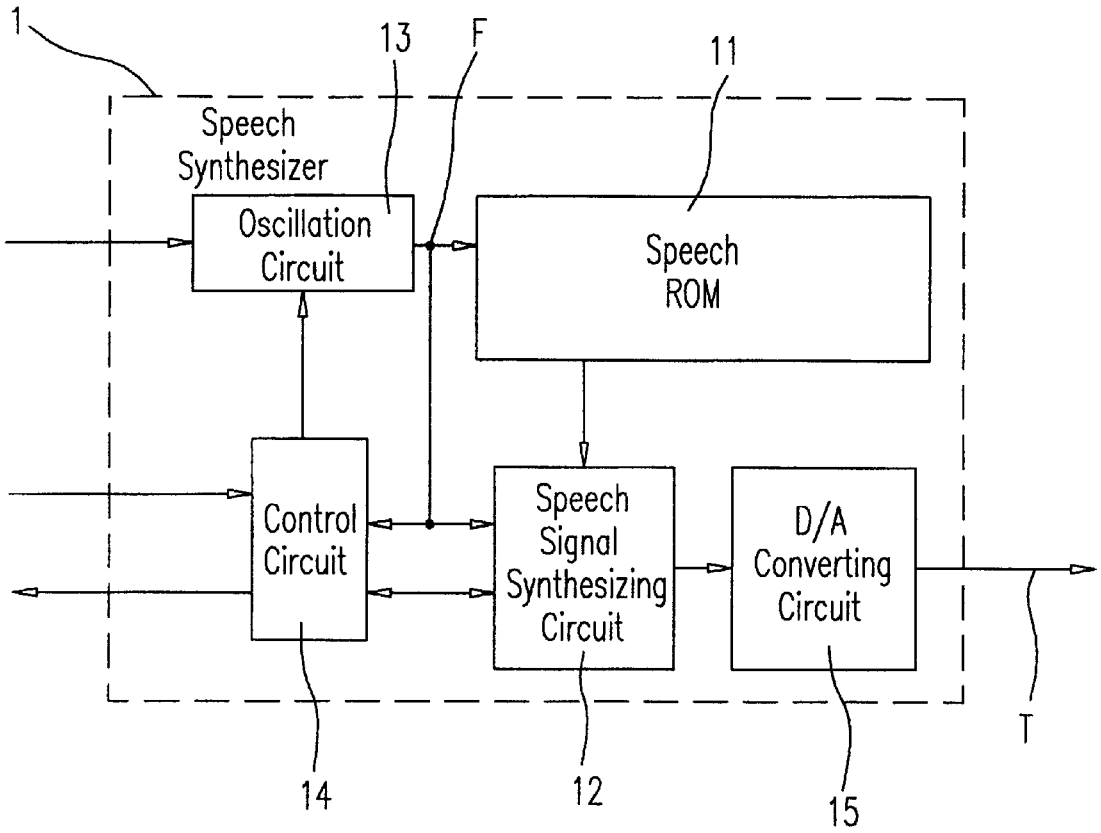
Fig. 1(PRIOR ART)
FIG. 1 is a block diagram showing a first conventional speech synthesizer.
Figure 2A:
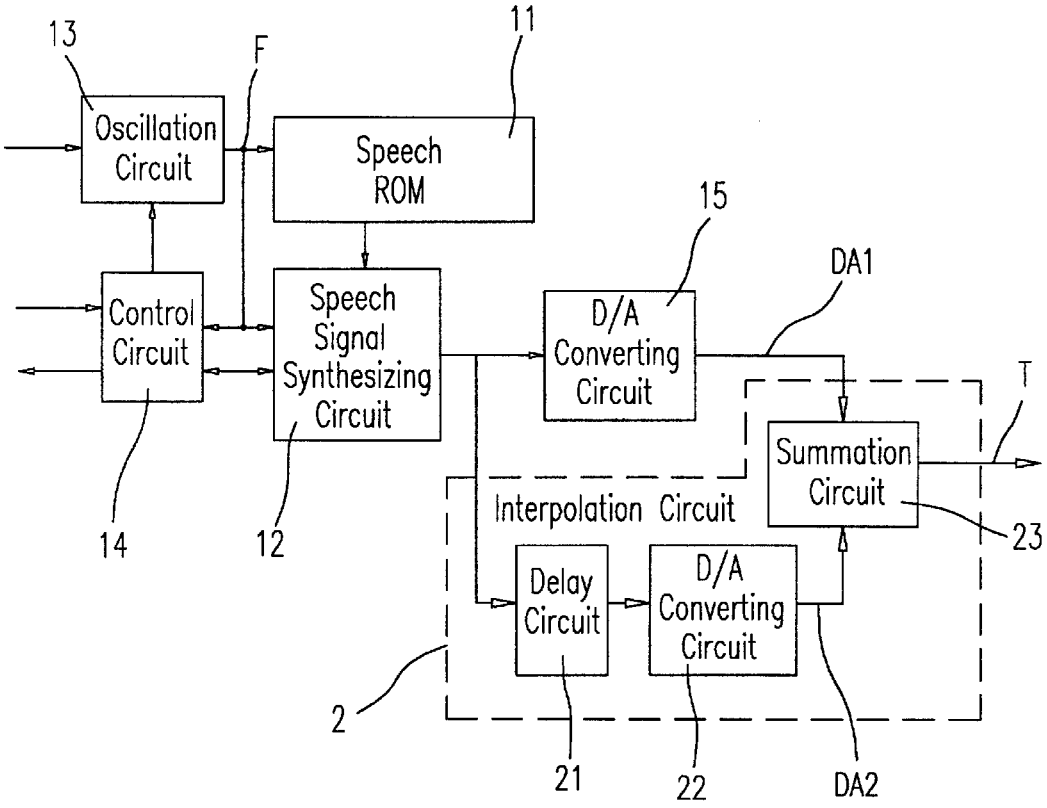
Fig. 2A(PRIOR ART)
FIG. 2A is a block diagram showing a second conventional speech synthesizer.
Figure 2B:
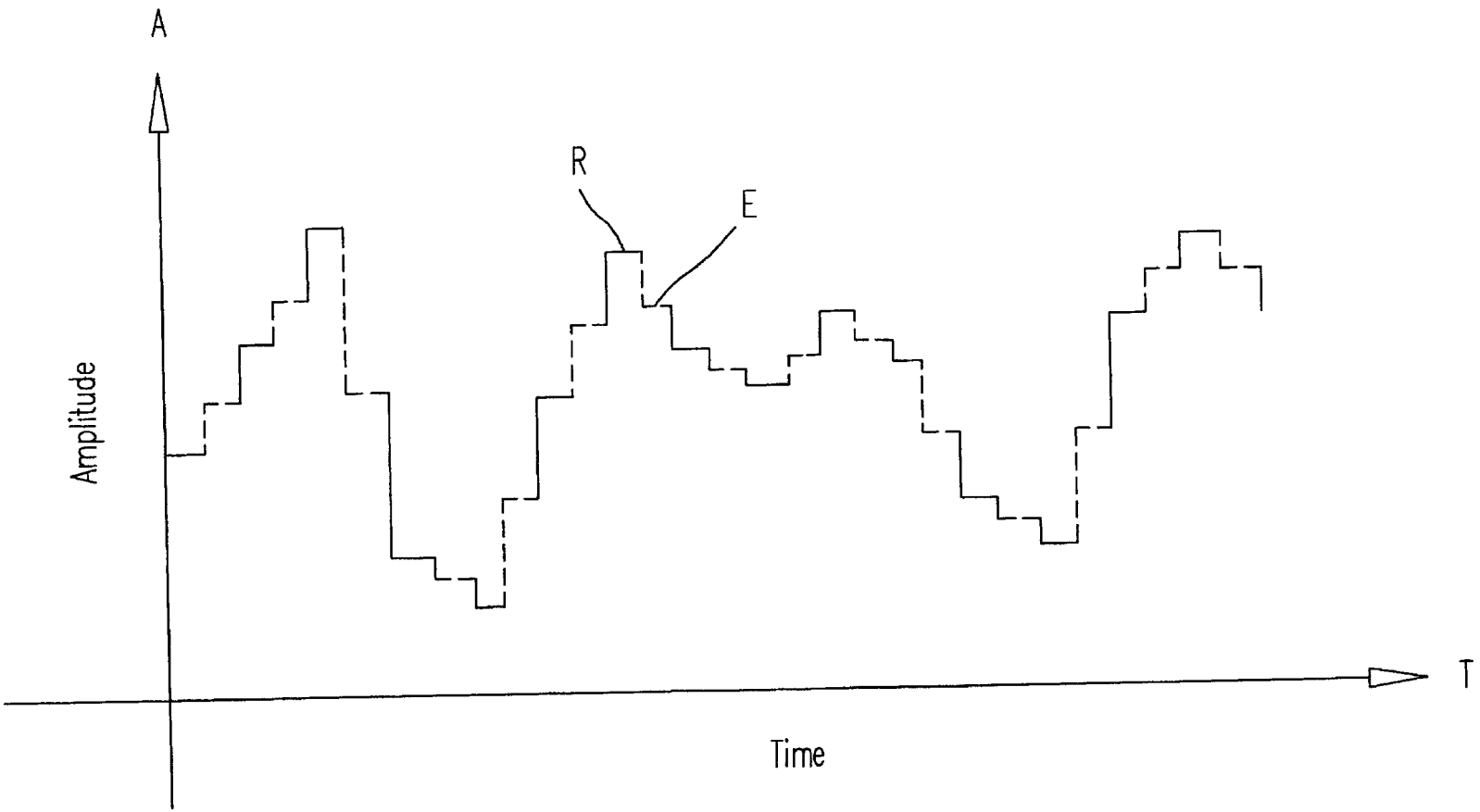
Fig. 2B (PRIOR ART)
FIG. 2B schematically shows the waveform of the speech synthesized signals generated by the speech synthesizer shown in FIG. 2A.
Figure 3:
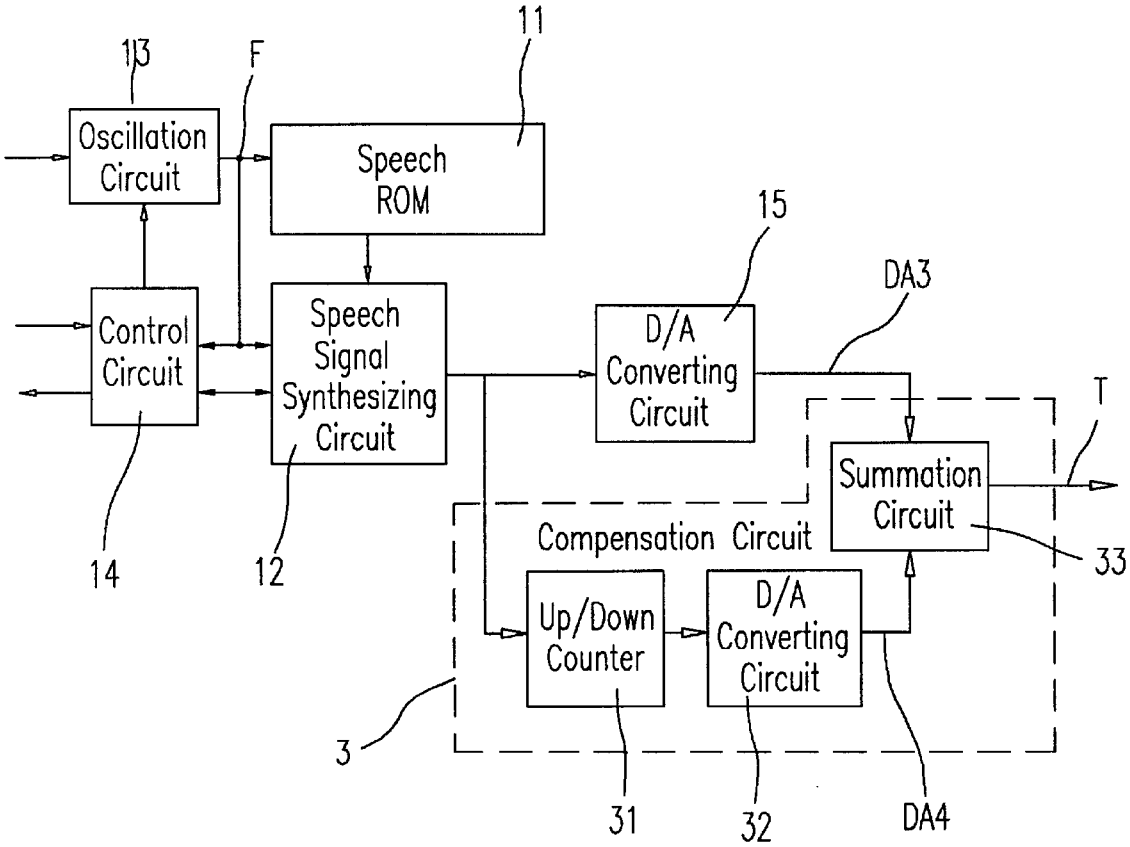
Fig. 3(PRIOR ART)
FIG. 3 is a block diagram showing a third conventional speech synthesizer.
Figure 4:
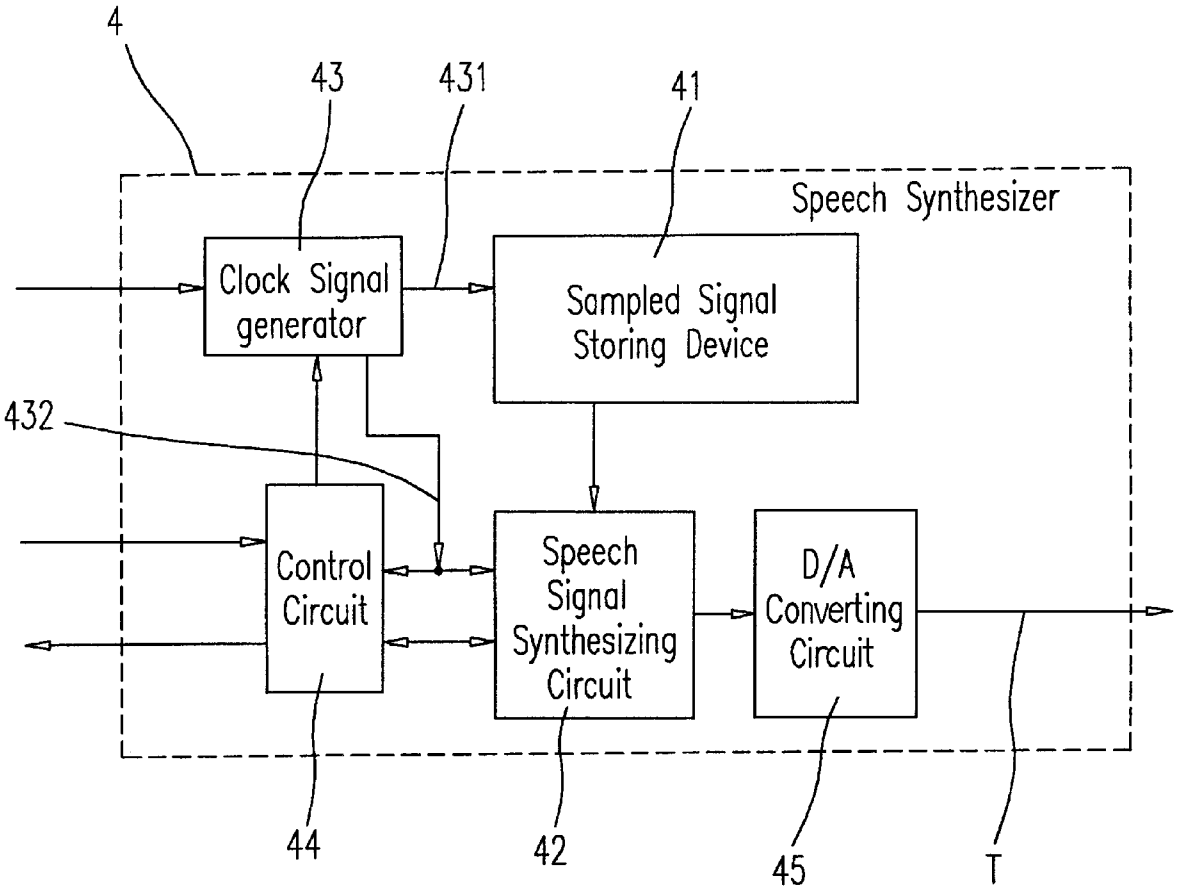
FIG. 4 is a block diagram showing a preferred embodiment of a speech synthesizer according to the present invention.
Figure 5:
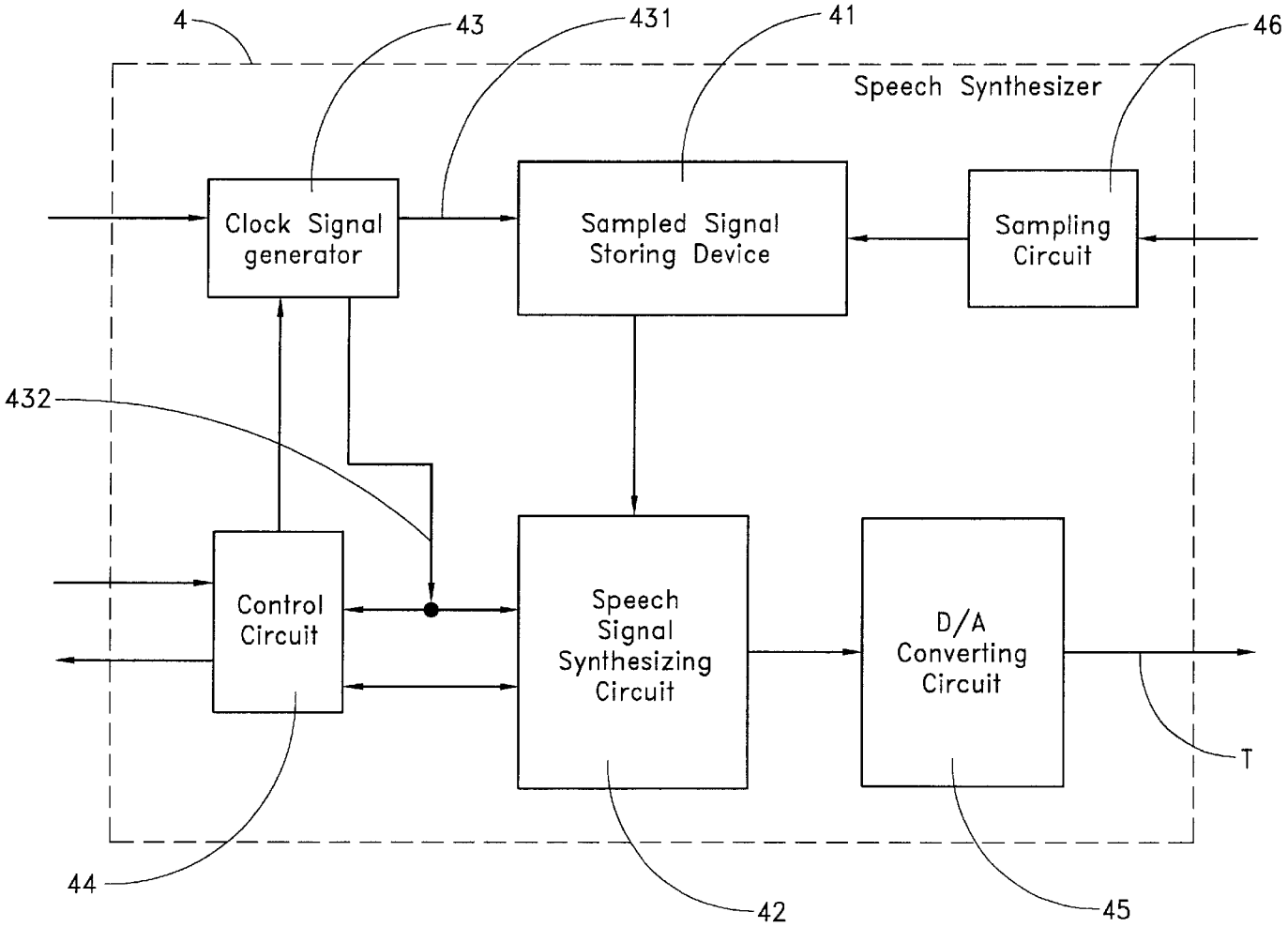
FIG. 5 is a block diagram showing a speech synthesizer having a sampling circuit.

Please refer to FIG. 4 which is a block diagram showing a preferred embodiment of a speech synthesizer according to the present invention. The speech synthesizer 4 includes a sampled signal storing device 41, a speech signal synthesizing circuit 42, a clock signal generator 43, a control circuit 44 and a digital/analog (D/A) converting circuit 45. In this preferred embodiment, the main structure of the speech synthesizer 4 shown in FIG. 4 is similar to that shown in FIG. 1. For example, the sampled signal storing device 41, speech signal synthesizing circuit 42, control circuit 44 and D/A converting circuit 45 respectively perform the same functions as the speech ROM 11, speech signal synthesizing circuit 12, control circuit 14 and D/A converting circuit 15 do. The descriptions related to these devices and circuits are not to be repeated here.

The most important feature of the present invention is that the values of data are stored in the sampled signal storing device 41. Preferably, the sampled signal storing device 41 is a speech ROM. Conventionally, the analyzed speech signal is pre-stored in the speech ROM, and when the speech signal synthesizing is proceeded, the stored data is read out from the speech ROM and processed by an external interpolation circuit or compensation circuit to increase the resolution of the outputted speech synthesized signal. The idea of the present invention is that, during the analyzing step, the value of the data representing the speech signal is pre-threaded, so that these data can be repeatedly operated during synthesizing without interpolating circuit or compensating circuit.

The speech signal synthesizing circuit 42 is electrically connected to the sampled signal storing device 41, receives the operation signal, has the sampled signal outputted by the sampled signal storing device 41 be repeatedly operated in response to the operation signal, and then outputs a speech synthesized signal, wherein a frequency of the operation signal is higher than that of the reading signal to allow the sampled signal to be repeatedly operated during a single cycle of the reading signal.

The present invention is characterized in that the clock signal generator 43, e.g. an oscillation circuit, is capable of generating e.g. two signals having different kinds of frequencies, i.e. the reading signal and the operation signal. The reading signal and the operation signal are respectively inputted into the sampled speech signal storing device 41 and the speech signal synthesizing circuit 42 through two output terminals 431 and 432 of the clock signal generator 43. Furthermore, the frequency of the operation signal is higher than that of the reading signal. For example, the former frequency is a multiple of the latter one, wherein the multiple can be an integer or a non-integer.

By utilizing the speech synthesizer according to the present invention, the effect on improving the speech synthesizing performance which is able to be achieved by the interpolation method can be achieved. Moreover, owing to the increase of the operation times to obtain more data points, the outputted speech synthesized signal is accordingly more smooth than the conventional one, and the waveform generated by the present invention is nearer to the original speech signal than the waveforms generated by the conventional speech synthesizers.

Figure 6A:
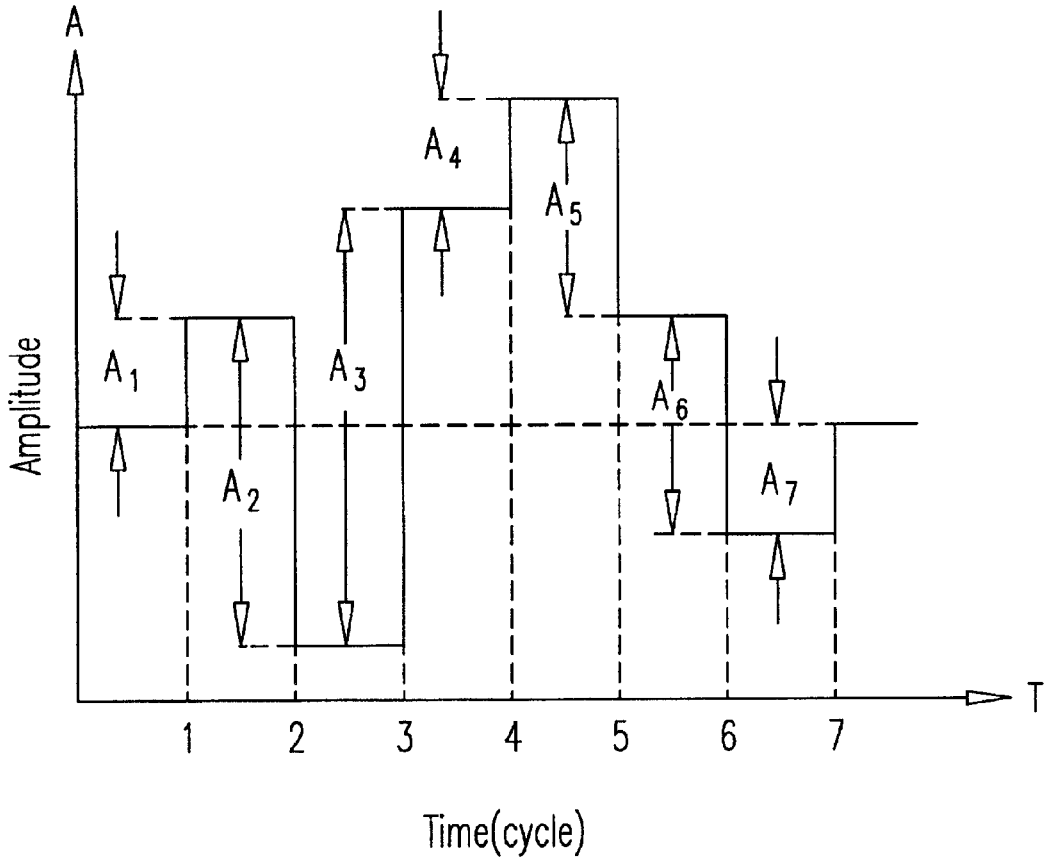
FIGS. 6A~6C schematically show the waveforms of the speech synthesized signals generated by the speech synthesizer shown in FIG. 4 in a DPCM speech synthesizing system.

In order to further illustrate the present invention, two operation methods according to the present invention respectively used for two speech synthesizing systems, the DPCM and the ADPCM, are given for examples as follows. The present invention can also be found to be an economical speech synthesizer which can easily obtain a satisfactory speech quality from the following examples. Please refer to FIGS. 6A~6C which schematically show the waveforms of the speech synthesized signals generated by the speech synthesizer shown in FIG. 4 in a DPCM speech synthesizing system. The waveform shown in FIG. 6A shows the analyzed sampled results of speech signals. The symbols $A_1$, $A_2$, . . . $A_6$, $A_7$ represent seven sampled results.

Assuming that the frequency of the operation signal is twice that of the reading signal, the sampled results are processed by being divided by a converting parameter equal to the multiple, i.e. 2, to obtain the amplitudes of the stored sampled signals before they are stored into the speech ROM. In other words, the amplitudes of the stored sampled signals are $A_1/2$, $A_2/2$, . . . , $A_{n-1}/2$, $A_n/2$, which are respectively defined as $D_1$, $D_2$, . . . , $D_{n-1}$, $D_n$. The reason why the stored sampled results are divided by the multiple, e.g. 2, to be converted is that within each single cycle of the reading signal, the divided sampled signal is operated twice. If the non-divided sampled result is directly used as the amplitude of the sampled signal, the amplitude of the speech synthesized signal after two operations will become almost double the amplitude of the speech signal to be synthesized, and thus a distortion effect is caused.

In the speech synthesizer in the DPCM speech synthesizing system according to the present invention, the sampled signal is operated according to an operation equation (a) listed below:

$$A(t+1/M)=A(t)+D_i \qquad (a),$$

wherein A(t) is an amplitude of the speech synthesized signal at a variable time t;

A(t+1/M) is an amplitude of the speech synthesized signal at a variable time (t+1/M);

M is the converting parameter; and $D_i$ is an amplitude of the ith sampled signal stored in the sampled signal storing device.

The equation (a) has a boundary condition of A(0)=0 and a known condition of $D_i=A_i/M$ wherein $A_i$ is the ith sampled result. The amplitude $D_i$ remains unchanged during a time interval between t and (t+1). For example, if M=2, each data point is obtained every a half reading cycle and the relationship between the amplitudes of the sampled signals and those of the sampled results are described by operating them with equation (a).

$$A(0) = 0$$

$$A(1/2) = A(0+1/2) = A(0) + D_1 = 0 + A_1/2 = A_1/2;$$

$$A(1) = A(1/2+1/2) = A(1/2) + D_1 = A_1/2 + A_1/2 = A_1;$$

$$A(3/2) = A(1+1/2) = A(1) + D_2 = A_1 + A_2/2;$$

$$A(2) = A(3/2+1/2) = A(3/2) + D_2 = A_1 + A_2/2 + A_2/2 = A_1 + A_2;$$

$$A(5/2) = A(2+1/2) = A(2) + D_3 = A_1 + A_2 + A_3/2;$$

$$A(3) = A(5/2+1/2) = A(5/2) + D_3 = A_1 + A_2 + A_3/2 + A_3/2 = A_1 + A_2 + A_3;$$

$$\vdots$$

$$A((2n-1)/2) = A_1 + A_2 + \ldots + A_{n-1} + A_n/2; \text{ and}$$

$$A(n) = A_1 + A_2 + \ldots + A_{n-1} + A_n, \text{ wherein } n \text{ is an integer.}$$

Figure 6B:
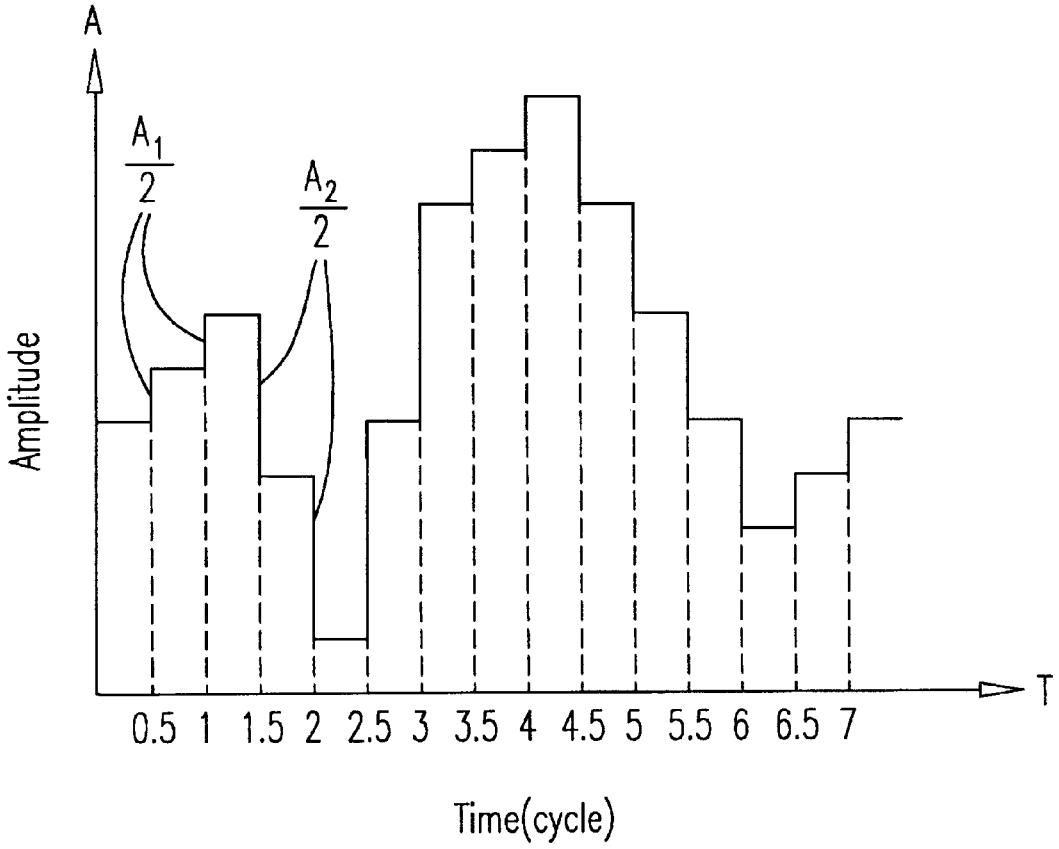

The aforementioned operation results are shown in FIG. 6B. The working principles of this preferred embodiment of the speech synthesizer according to the present invention are to raise the frequency of the operation signal to a multiple of that of the conventional one and simultaneously to lower the amplitude of the sampled result to a reciprocal of the multiple. This operation method has the same effect on improving the speech quality as the interpolation method has, but it does not need any interpolation circuit to achieve the purpose.

Figure 6C:
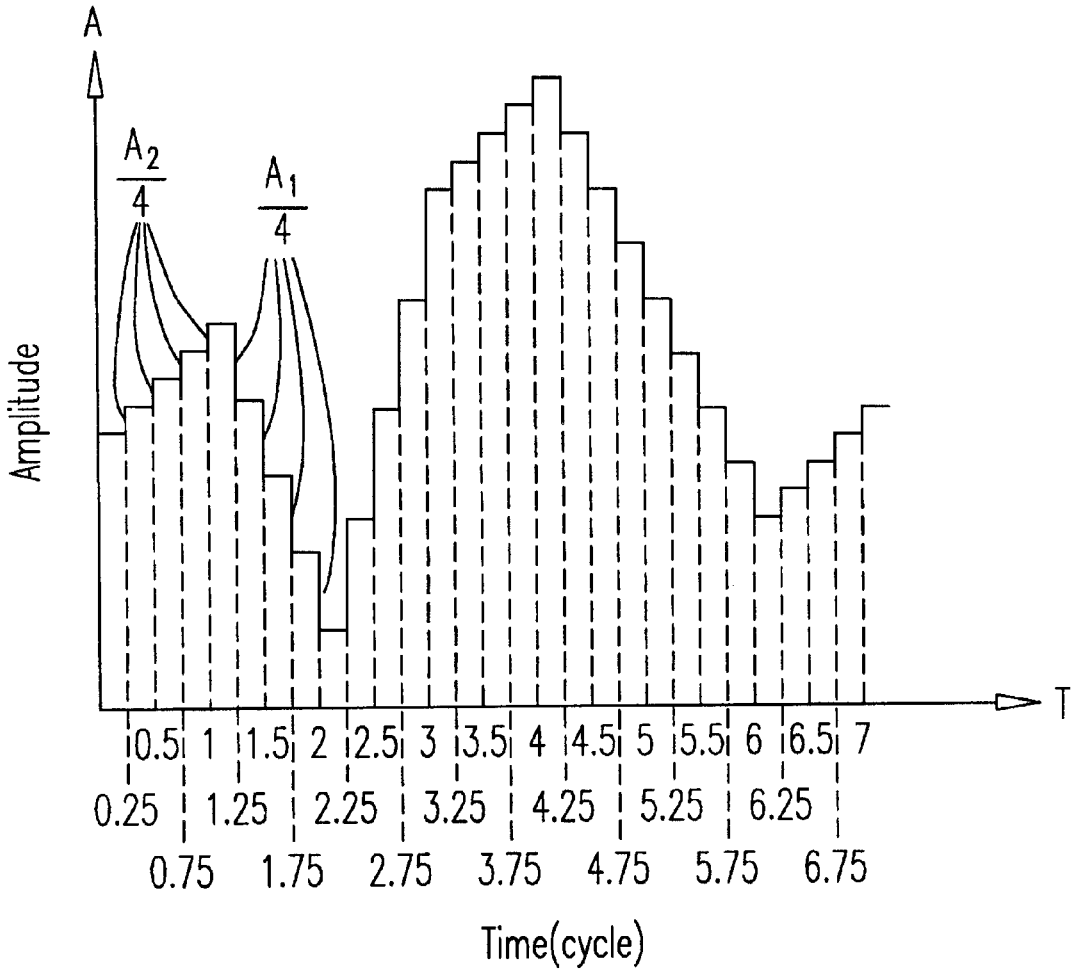

FIG. 6C schematically shows another kind of waveform of the speech synthesized signals generated by the speech synthesizer shown in FIG. 4 in a DPCM speech synthesizing system. In this case, the converting parameter M is assumed to be 4, the amplitudes of the sampled signals, $D_1$, $D_2$, . . . , $D_{n-1}$, $D_n$ are accordingly equal to $A_1/4$, $A_2/4$, . . . , $A_{n-1}/4$, $A_n/4$, and the operation results are shown below.

$$A(0) = 0$$

$$A(1/4) = A(0 + 1/4) = A(0) + D_1 = 0 + A_1/4 = A_1/4;$$

$$A(2/4) = A(1/4 + 1/4) = A(1/4) + D_1 = A_1/4 + A_1/4 = A_1/2;$$

$$A(3/4) = A(2/4 + 1/4) = A(2/4) + D_1 = A_1/2 + A_1/4 = (3/4)A_1;$$

$$A(1) = A(3/4 + 1/4) = A(3/4) + D_1 = (3/4)A_1 + A_1/4 = A_1;$$

$$A(5/4) = A(1 + 1/4) = A(1) + D_2 = A_1 + A_2/4;$$

$$A(6/4) = A(5/4 + 1/4) = A(5/4) + D_2 = A_1 + A_2/4 + A_2/4 = A_1 + A_2/2;$$

$$A(7/4) = A(6/4 + 1/4) = A(6/4) + D_2 = A_1 + A_2/2 + A_2/4 = A_1 + (3/4)A_2;$$

$$A(2) = A(7/4 + 1/4) = A(7/4) + D_2 = A_1 + (3/4)A_2 + A_2/4 = A_1 + A_2;$$

$$\vdots$$

$$A((4n-3)/4) = A_1 + A_2 + \ldots + A_{n-1} + (1/4)A_n$$

$$A((4n-2)/4) = A_1 + A_2 + \ldots + A_{n-1} + (2/4)A_n$$

$$A((4n-1)/4) = A_1 + A_2 + \ldots + A_{n-1} + (3/4)A_n; \text{ and}$$

$A(n) = A_1 + A_2 + \ldots + A_{n-1} + A_n$, wherein $n$ is an integer.

Figure 7:
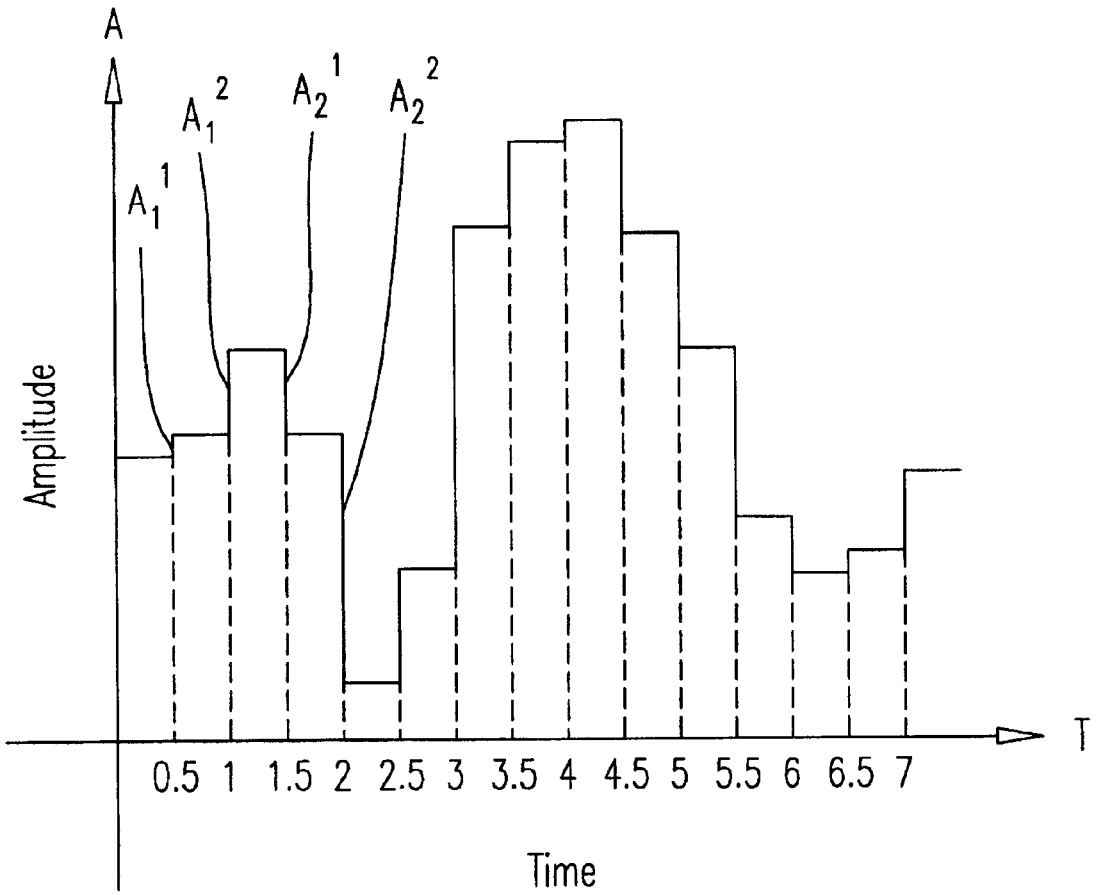
FIG. 7 schematically shows the waveform of the speech synthesized signals generated by the speech synthesizer shown in FIG. 4 in an ADPCM speech synthesizing system.

In the speech synthesizer in the ADPCM speech synthesizing system according to the present invention, the sampled signal is operated according to operation equations (b) and (c) listed below and the operation results are shown in FIG. 7.

$$A(t+1/M)=A(t)+f_i(Q(t))*D_i=A(t)+A_1^j \quad (b),$$

and $$Q(t+1/M)=Q(t)+f_2(Q(t),D_i) \quad (c),$$

wherein

A(t) is an amplitude of the speech synthesized signal at a variable time t;

A(t+1/M) is an amplitude of the speech synthesized signal at a variable time (t+1/M);

Q(t) is a quantization step of the speech synthesized signal at the variable time t;

Q(t+1/M) is a quantization step of the speech synthesized signal at the variable time (t+1/M);

M is the converting parameter;

$f_1(Q(t))$ is an amplitude magnitude function of Q(t);

$f_2(Q(t),D_i)$ is a quantization-step differential function of Q(t) and $D_i$;

$D_i$ is an amplitude of the ith sampled signal stored in the sampled signal storing device; and $A_i^j$ is an amplitude magnitude of the ith sampled signal after the sampled signal is processed j times wherein 1<j<M. The equation (b) includes a boundary condition of A(0)=0 and a known condition of $$A_i = \sum_{j=1}^{M} A_i^j$$

wherein $A_i$ is the ith sampled result, and the sampled signal is sequentially operated M times. According to the known sampled results $A_i$, the boundary condition and the equations, the sampled signals $D_i$ can be estimated by shooting method or other numerical methods during the speech analyzing process. Then the sampled signals $D_i$ are stored in the speech ROM to be utilized in the speech synthesizing process. The amplitude $D_i$ remains unchanged during a time interval between t and (t+1). For example, if M=2, each data point is obtained every a half reading cycle and the relationship between the amplitudes of the sampled signals and those of the sampled results are described by operating them with equations (b) and (c).

$$A(0) = 0$$

$$A(1/2) = A(0 + 1/2) = A(0) + f_1(Q(0)) * D_1 = 0 + A_1^1 = A_1^1$$

$$Q(1/2) = Q(0 + 1/2) = Q(0) + f_2(Q(0), D_1)$$

$$A(1) = A(1/2 + 1/2) = A(1/2) + f_1(Q(1/2)) * D_1 = A_1^1 A_1^2 = A_1$$

$$Q(1) = Q(1/2 + 1/2) = Q(1/2) + f_2(Q(1/2), D_1)$$

$$A(3/2) = A(1 + 1/2) = A(1) + f_1(Q(1)) * D_2 = A_1 + A_2^1$$

$$Q(3/2) = Q(1 + 1/2) = Q(1) + f_2(Q(1), D_2)$$

$$A(2) = A(3/2 + 1/2) = A(3/2) + f_1(Q(3/2)) * D_2 = A_1 + A_2^1 + A_2^2 = A_1 + A_2$$

$$Q(2) = Q(3/2 + 1/2) = Q(3/2) + f_2(Q(3/2), D_2)$$

$$\vdots$$

$$A((2n-1)/2) = A_1 + A_2 + \ldots + A_{n-1} + A_n^1$$

$$Q((2n-1)/2) = Q((n-1) + 1/2) = Q(n-1) + f_2(Q(n-1), D_n)$$

$$A(n) = A_1 + A_2 + \ldots + A_{n-1} + A_n$$

$$Q(n) = Q((2n-1)/2 + 1/2) = Q((2n-1)/2) + f_2(Q((2n-1)/2), D_n)$$

wherein n is an integer.

From the aforementioned examples, it is found that instead of directly storing the sampled results Ai in the speech ROM, the present invention pre-operates these sample results $A_i$ during the speech analyzing process to obtain sampled signals $D_i$ to be stored in the speech ROM. Each of the sampled signals $D_i$ can be repeatedly read from the speech ROM to be operated M times without external interpolating or compensating circuit to obtain the speech synthesized signals A(t). Accordingly, a higher resolution of the synthesized result is obtain without external circuits. Repeatedly reading the sample signal $D_i$ can be achieved by mapping addresses to the same data. For example, if M=4, the sampled signal to be repeatedly read is $D_1$. Then, we can assign that $D_1$=00000~00011, that is, the four addresses 00000~00011 are mapped to the same data $D_i$.

To sum up, from the aforementioned examples, the present invention proceeds a plurality of times of operation for each entry of data in the storing device so that the synthesizing performance of the present synthesizer can be improved without increasing the storage amount of the sampled signals.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A speech synthesizer comprising:

a sampled signal storing device therein a sample signal and outputting said sampled signal in response to an input signal; and a speech signal synthesizing circuit electrically connected to said sampled signal storing device, receiving an operation signal, having said sampled signal outputted by said sampled signal storing device to be repeatedly operated M times in response to said operation signal, and then outputting a speech synthesized signal, wherein a frequency of said operation signal is M times of a frequency of said input signal to allow said sampled signal to be repeatedly operated M times during a single cycle of said input signal, wherein said sampled signal is operated according to operation equations (b) and (c) listed below:

$$A(t+1/M)=A(t)+f1(Q(t))Di=A(t)+Aij \quad (b),$$

and $$Q(T+1/M)=Q(t)+f2(Q(t),Di) \quad (c),$$

wherein

A(t) is an amplitude of said speech synthesized signal at a variable time t;

A(t+1/M) is an amplitude of said speech synthesized signal at a variable time (t+1/M);

Q(T) is a quantization step of said sampled signal at said variable time t;

Q(t+1/M) is a quantization step of said sampled signal at said variable time (t+1/M);

M is a predetermined converting parameter;

f1(Q(t)) is an amplitude magnitude function of Q(t);

f2(Q(t)), Di) is a quantization-step differential function of Q(t) and Di;

Di is an amplitude of the ith sampled signal stored in said sampled signal storing device; and Ai j is an amplitude magnitude of said ith sampled signal after said sampled signal is processed j times where in $1 \leqq j \leqq M$.

2. A speech synthesizer according to claim 1 wherein said sampled signal is generated by having a sampled result processed by an amplitude magnitude function and a quantization-step differential function in an adaptive differential pulse code modulation (ADPCM) speech synthesizing system, and said equation (b) includes a boundary condition of A(0)=0 and a known condition of $$A_i = \sum_{j=1}^{M} A_i^j$$

wherein $A_i$ is an amplitude of the ith of said sampled result, and said sampled signal is sequentially operated M times.

3. A speech synthesizer according to claim 2 wherein said amplitude $D_i$ remains unchanged during a time interval between t and (t+1).

4. A speech synthesizer according to claim 1 wherein said input signal is a reading signal.

5. A speech synthesizer according to claim 1 wherein said operation signal and said input signal are respectively inputted into said sampled signal storing device and said speech signal synthesizing circuit.

6. A speech synthesizer according to claim 1 wherein said sampled signal storing device is a speech read-only-memory (ROM).

7. A speech synthesizer according to claim 1 further comprising a clock signal generator electrically connected to said sampled signal storing device and said speech signal synthesizing circuit for outputting said input signal to said sampled signal storing device and outputting said operation signal to said speech signal synthesizing circuit.

8. A speech synthesizer according to claim 7 wherein said clock signal generator is an oscillation circuit capable of generating and outputting signals having different kinds of frequencies.

9. A speech synthesizer according to claim 8 further comprising:

a control circuit electrically connected to said clock signal generator and said speech signal synthesizing circuit for serving as an input/output processing interface; and a digital/analog converting circuit electrically connected to said speech signal synthesizing circuit for transforming said speech synthesizing signal from a digital signal into an analog signal to be outputted.

* * * * *